US005920168A

United States Patent [19]

Lewis

[11] Patent Number: 5,920,168

[45] Date of Patent: Jul. 6, 1999

[54] APPARATUS AND METHOD OF REGULATING THE TEMPERATURE OF SOLID FUEL STOVES

[76] Inventor: Dennis R. Lewis, 22 Berkshire Cir., Ware, Mass. 01082

[21] Appl. No.: 08/996,966

[22] Filed: Dec. 23, 1997

[51] Int. Cl.[6] ..... F23B 7/00; F23N 5/14

[52] U.S. Cl. ..... 318/471; 318/268; 110/186; 110/101 C

[58] Field of Search ..... 318/471, 268, 318/244, 245; 110/185, 186, 267, 101 R, 101 C

[56] References Cited

U.S. PATENT DOCUMENTS 2,162,116 6/1939 Peltz .
3,949,936 4/1976 Boyer et al. .
4,049,193 9/1977 Haviland et al. .
4,519,323 5/1985 Takano et al. .
4,598,648 7/1986 D'Angelo .
4,697,530 10/1987 Marcotte et al. .

*Primary Examiner*—Bentsu Ro
*Attorney, Agent, or Firm*—McCormick, Paulding & Huber

[57] ABSTRACT

A speed controller for motors of a solid fuel stove or stoker includes a bidirectional switch, such as a thyristor, to be interposed along an ac power line. The controller operates in a speed control mode for sending reduced power to a stove when a space thermostat is satisfied. The speed control mode may be automatically modulated between minimum and maximum in response to remote sensors, such as a thermistor. The controller may also provide a power-up mode for a predetermined period of time to supply full power to stove motors upon start-up, such as after a power outage. The controller may also provide full power to the stove motors when the motors are being powered by an inverter.

18 Claims, 1 Drawing Sheet

APPARATUS AND METHOD OF REGULATING THE TEMPERATURE OF SOLID FUEL STOVES

FIELD OF THE INVENTION

The present invention relates generally to an apparatus and method of controlling solid fuel stoves, and more particularly with regulating the temperature of solid fuel stoker stoves and furnaces.

BACKGROUND OF THE INVENTION

Solid fuel burning appliances such as stoker stoves and furnaces for heating rooms require some means of control to have the heat output be responsive to the temperature in the space served by the appliance. Several methods have been used to accomplish this. One method is to run the stoker in an "on-off" mode where the stoker runs when the space thermostat calls for heat, and when the space thermostat is satisfied the stoker runs for some selected period and then is off for some selected period. This "on-off" operation does respond to the thermostat, but the "on-off" timing must be carefully selected to maintain the fire. Other problems with the "on-off" operation are that the fire is slow to come back to full fire after an off period, the "on-off" timing must be changed dependent on the weather, overheating of the space occurs in marginal weather when the "off" periods cannot be made longer without having the fire go out, and some fuel is wasted in letting the fire die down and then be brought back.

A problem with stove controllers is that there is always the possibility of a power interruption while the burn rate is reduced. In the "low fire" mode the average power to the stoker may not be high enough to restart the motors running the stoker. A further problem is that a stoker type appliance will not supply heat unless power is available to the stoker. The waveform of a voltage supplied by inverters can cause poor operation of speed controls.

It is an object of the present invention to overcome the drawbacks and disadvantages or prior art controllers for solid fuel stoves.

SUMMARY OF THE INVENTION

A speed controller for a solid fuel stove includes a bidirectional switch to be interposed along an ac power line. The switch has a first operating terminal to be coupled to an ac power source and second operating terminal to be coupled to a solid fuel stove power terminal, and a control terminal for activating the switch to pass ac electrical power to the stove via the switch when the control terminal is energized. A full wave rectifier is to be coupled to the ac power source for generating full wave rectified DC waveform cycles. Means is provided for comparing a voltage magnitude of the full wave rectified DC sinewaves to that of a DC reference voltage having an averaged magnitude derived from the full wave rectified DC sinewaves, and sending an activation signal to the control terminal of the bidirectional switch for turning-on the switch to pass power to the stove during a portion of each ac waveform cycle when the voltage magnitude of the rectified DC waveform is generally greater than or equal to that of the DC reference voltage, whereby the stove operates in a reduced or speed control mode. Means are also provided for being coupled to a thermostat for sending an activation signal from the thermostat to the control terminal of the bidirectional switch for turning-on the switch and overriding the speed control mode to substantially pass full ac power waveforms to the stove to operate the stove, whereby the stove operates in a full power mode. Means may also be provided for overriding the speed control mode and passing full ac power waveforms to the stove for a predetermined period of time upon start-up of the stove control.

One advantage of the present invention is that the controller has a speed control mode capable of changing the firing rate. The fire is always in a burn mode, but the rate of feed and forced draft is changed in response to the space thermostat so that when the space thermostat is satisfied the burn rate is reduced rather than stopping the feed and draft. In this way the fire does not go out or die down, it just burns at a lower rate. Thus fuel waste is minimized and the fire responds much faster to a call for heat by the thermostat. For convenience this response to the space thermostat is automatic and the burn rate is responsive to the demand for heat.

Another advantage of the present invention is that the control may also provide full power to the stove motor(s) upon power-up to prevent the stove motor(s) from stalling.

A further advantage of the present invention is that the control may provide full power to the stove motor(s) when the stove is powered by an inverter in order to prevent speed control problems often encountered because of poorly-shaped waveforms generated by inverters.

A yet further advantage of the present invention is that outside sensors may be coupled to the stove controller embodying the present invention to provide adjustable regulation of the stove motor speed.

Other advantages of the present invention will become apparent in view of the following detailed description and accompanying drawing.

DETAILED DESCRIPTION OF A PREFERRED EMBODIMENT

Figure 1:
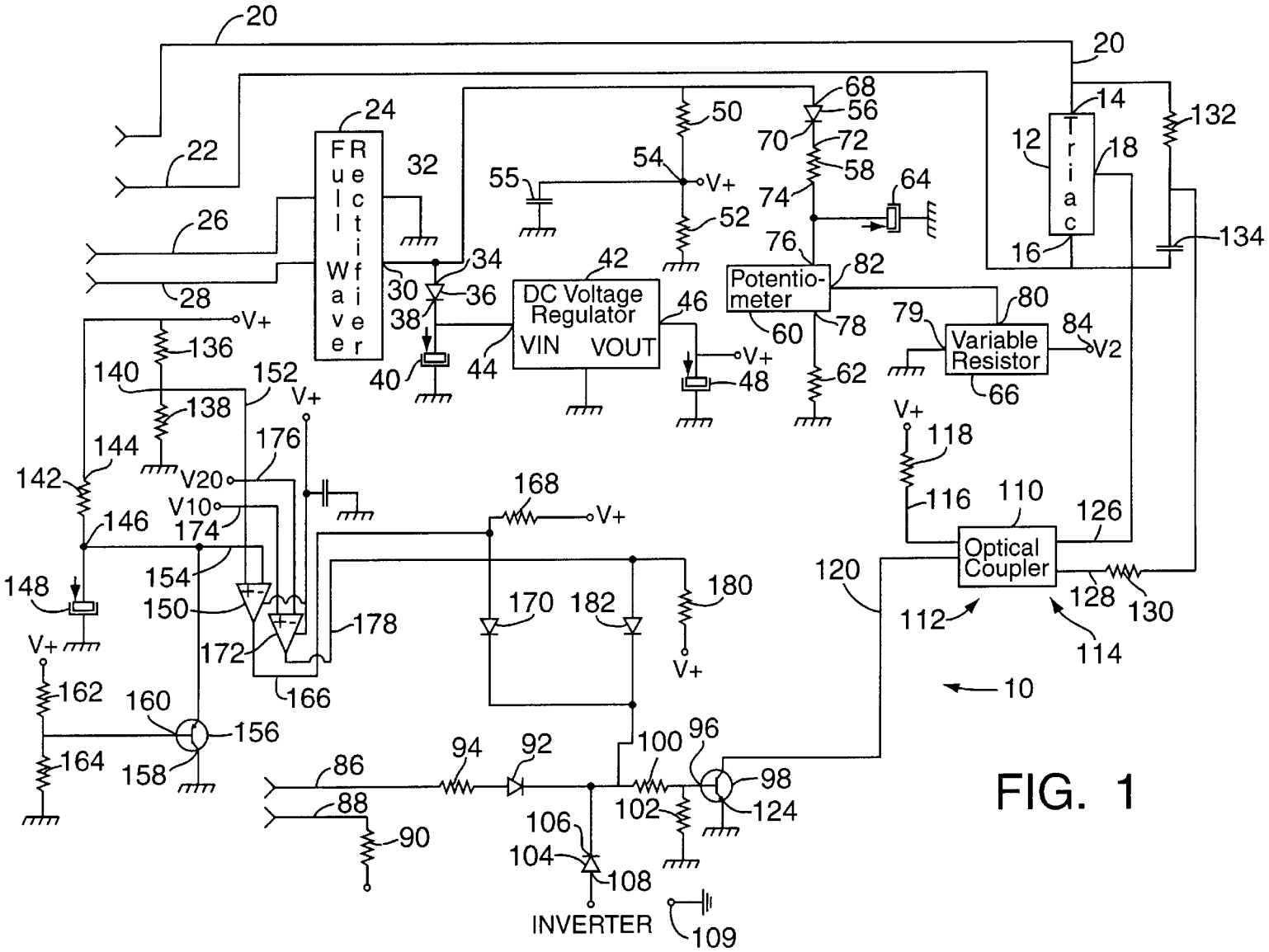
FIG. 1 schematically shows a stove control circuit in accordance with the present invention.

Turning now to FIG. 1, a stove controller embodying the present invention is generally designated by the reference number 10. A thyristor 12, such as a triac, includes first and second terminals 14, 16, and a gate 18. The first terminal 14 of the thyristor 12 is to be coupled to an ac power line 20 coupled to an ac power source (not shown) for supplying, for example, 120 VAC or other commercially useful voltage level. The second terminal 16 of the thyristor 12 is to be coupled via a supply line 22 to a power input terminal of a solid fuel stove (not shown), such as a stoker stove or furnace. The thyristor is so interposed along the ac power line which includes the lines 20 and 22 so that power flow to the stove is interrupted when the thyristor is inactive, and power is passed to the stove for its operation via the thyristor when the thyristor is activated.

A full wave rectifier 24 includes first and second ac terminals 26, 28 to be coupled to an output of a step-down transformer (not shown) for receiving a reduced ac voltage waveform of about, for example, 16 VAC to 20 VAC for powering internal or external circuit components. The rectifier 24 further includes a positive output terminal 30 and a negative output terminal 32 coupled to ground potential. The positive terminal 30 of the rectifier 24 is coupled to an anode 34 of a reverse blocking diode 36. A cathode 38 of the diode 36 is coupled to ground via a filter capacitor 40. A DC voltage regulator 42, such as for example a 12 volt DC regulator, has an input terminal 44 coupled to a junction between the diode 36 and the capacitor 40, and a DC voltage supply terminal 46 for supplying DC voltage to circuit components. An output filter capacitor 48 is interposed between the output terminal 46 of the DC voltage regulator 42 and ground potential.

Series connected resistors 50, 52 form a voltage divider network, and are coupled between the positive output terminal 30 of the rectifier 24 and ground potential. A junction 54 between the resistors 50, 52 supplies a voltage V1 which is a reduced voltage sample of the half sinewaves generated by the rectifier 24. The purpose of V1 will be explained shortly. A by-pass capacitor is coupled between the junction 54 and ground potential.

A reference voltage circuit includes a reverse blocking diode 56, a resistor 58, a potentiometer 60, a resistor 62, stabilizing capacitor 64 and a variable resistor 66. The diode 56 has its anode 68 coupled to the positive terminal 30 of the rectifier 24, and its cathode 70 coupled to a first terminal 72 of the resistor 58. A second terminal 74 of the resistor 58 is coupled to ground potential via the capacitor 64, and is also coupled to a first terminal 76 of the potentiometer 60. A second terminal 78 of the potentiometer 60 is coupled to ground potential via the resistor 62. A first terminal 80 of the variable resistor 66 is coupled to a wiper 82 of the potentiometer 60, and a second terminal 84 of the variable resistor 66 supplies a DC voltage V2, the purpose of which will be explained shortly.

First and second thermostat terminals 86, 88 are to be coupled to a thermostat (not shown) for activating the gate 18 of the thyristor 12 when the temperature of a space to be heated falls below a predetermined level as sensed by the thermostat. The thermostat receives power at the second terminal 88 supplied from the V+ terminal via a current limiting resistor 90. A reverse blocking diode 92 has its anode coupled to the first thermostat terminal 86 via a current limiting resistor 94, and its cathode coupled to a base 96 of a transistor 98, such as an NPN 2N222, via resistor 100. The base 96 of the transistor 98 is coupled to ground potential via a pull-down resistor 102. A diode 104 has its cathode 106 coupled to the base 96 of the transistor 98 via the resistor 100, and its anode 108 to be coupled to an inverter sensing signal coming from an inverter (not shown) or as a result of the inverter being "on" for supplying full power to the stove when being powered by an inverter. Terminal 109 is a ground terminal to complete an external circuit (not shown) for generating an inverter sense signal.

An optical coupler 110, such as an MOC3010, links the transistor 98 to the gate 18 of the thyristor. More specifically, the optical coupler 110 includes a low voltage or control side 112 and a high voltage or controlled side 114. The low voltage side 112 includes a first terminal 116 coupled to the V+ terminal via a current limiting resistor 118. A second terminal 120 of the low voltage side 112 is coupled to a collector of the transistor 98. An emitter 124 of the transistor 98 is coupled to ground potential. The high voltage side 114 of the optical coupler 114 includes a first terminal 126 and a second terminal 128. The first terminal 126 is coupled to the gate 18 of the thyristor 12. The second terminal 128 is coupled to the first terminal 14 of the thyristor 12 via a current limiting resistor 130 and a resistor 132. The second terminal 128 on the high voltage side 114 of the optical coupler 110 is also coupled to the second terminal 16 of the thyristor 12 via the resistor 130 and a capacitor 134.

The terminal V+ is coupled to ground potential via series connected resistors 136, 138 which form a voltage divider carrying about ½ of the V+ voltage at a junction 140 between the resistors 136, 138. A resistor 142 has a first terminal 144 coupled to the V+ terminal, and a second terminal 146 coupled to ground potential via a capacitor 148. A power-up mode voltage comparator 150, such as part of an LM339, has a iion-inverting input 152 coupled to the junction 140 and an inverting input 154 coupled to the second terminal 146 of the junction between the resistor 142 and the capacitor 148. A PNP transistor 156, such as a 2N3906, has its emitter coupled to the inverting input 154 of the power-up comparator 150 and its collector 158 coupled to ground potential. A base 160 of the transistor 156 is coupled between series connected resistors 162, 164 of a voltage divider network where the resistors 162, 164 are coupled between V+ and ground potential. An output 166 of the power-up comparator 150 is coupled to the V+ terminal via a resistor 168. The output 166 of the power-up comparator 150 is also coupled to the base 96 of the transistor 98 via a diode 170 and the base resistor 100.

A speed control comparator 172 has a non-inverting input 174 coupled to the V1 terminal, and an inverting input 176 coupled to the V2 terminal. An output 178 of the speed control comparator 172 is coupled to the V+ terminal via a, resistor 180. The output 178 of the speed control comparator 172 is also coupled to the base 96 of the transistor 98 via a diode 182 and the base resistor 100.

The operation of the control circuit 10 will now be explained with reference to FIG. 1. A nominal 120 VAC enters the unit at line 20 and the average power to operate motors of a stove or stoker unit is controlled by the thyristor or triac 12.

The power for electronic components in the embodiment including an external thermostat circuit and other possible auxiliary devices is derived from a step-down transformer, such as a wall transformer, (not shown) that changes the 120 VAC to, for example, between about 16 and 20 VAC entering the unit at lines 26, 28. This reduced AC voltage is changed to full wave rectified DC by the bridge rectifier 24. The output from the rectifier 24 is a stream of half sine waves.

DC power for the electronic components, the thermostat and any auxiliary devices is provided by the reverse blocking diode 36, the filter capacitor 40, the DC voltage regulator 42 (supplying, for example, about 12 volts) and the output filter capacitor 48. The voltage regulator 42 allows the thermostat and any offboard auxiliary devices to be wired as "low voltage" with personal safety provided by the isolation from the normal power provided by the wall transformer. The DC voltage at the output 46 of the regulator 42 for powering the electronic components is marked as V+.

Speed control for regulating the speed of stove motors, such as a feeder motor and/or other motors (controlling a stove) is accomplished by activating the thyristor 12 at some point after the zero point in each half sine wave issuing from the rectifier 24. The activation of the thyristor 12 is controlled by the optical coupler 110. The optical coupler 110 also serves to isolate the higher voltage of the power line from the electronic components. The longer it takes to activate the thyristor after a zero crossing of each half cycle of ac power supplied to the thyristor 12, the less power is passed through the thyristor 12 to run a stove, and thus the speed of the stove will lower. If the thyristor is activated at about the zero crossing of each half cycle, substantially all power is passed from the ac power source to the stove such that the stove operates at full speed.

Power for activating the thyristor 12 is derived from a phase-shift and snubber network comprised of the resistors 132 and the capacitor 134, and current through the thyristor gate 18 is limited by the resistor 130. In other words, the capacitor 134 stores a charge during each half cycle of power supplied to the thyristor 12 from the ac power source so that the stored energy in the capacitor 134 is available at around a zero crossing of a new half cycle to pulse the gate 18 for activating or turning-on the thyristor 12 to power the stove.

The timing of the thyristor 12 activation is provided by the speed control comparator 172 that compares the voltage V1 of the half sinewaves from the rectifier 24 to the reference voltage V2 having an averaged magnitude derived from the same half sinewave. The controller 10 will work properly in the event that the line voltage sags or rises because V1 and V2 are derived from the same half sinewaves, and thus V1 and V2 follow the line voltage in lock-step. The resistors 50, 52 form a voltage divider to provide a reduced voltage sample of the half sinewave. The capacitor 56 is a by-pass capacitor to remove "noise" that could cause erratic operation. The sampled voltage marked V1 from the voltage divider formed by the resistors 50, 52 is fed to the non-inverting input 174 of the speed control comparator 172. The reference voltage V2 for the speed control comparator 172 is provided by the network of the reverse blocking diode 56, the resistor 58, the potentiometer 60 (used to set the minimum speed to prevent motor stalling), the resistor 62 and the stabilizing capacitor 64. The voltage at the wiper 82 of the potentiometer 60 is fed to the variable resistor 66.

The output from the variable resistance device 66, marked V2, is fed to the inverting terminal 176 of the speed control comparator 172. Thus when the sample voltage V1 rises above the reference voltage V2 the speed control comparator 172 output 178 goes high and provides a signal through the reverse blocking diode 182 to the base 96 of the NPN transistor 98 to turn the transistor 98 "on" and allow current to flow through the control side 112 of the optical coupler 110. This current is provided from the V+ source through the current limiting resistor 118. Once the current flows through the control side 112, current can flow through the controlled side 114 of the optical coupler 110 to provide current stored on the capacitor 134 for pulsing the gate 18 of the thyristor 12 to turn-on the thyristor 12 so that ac power can flow from the ac power source through the thyristor and into the stove. Because only a portion of each ac waveform where its voltage level V1 is greater than or equal to a DC reference voltage V2 passes through the thyristor 12 to the stove, the higher the reference voltage V2, the less power during each half cycle is supplied to the stove. Thus, the higher the reference voltage V2 the slower the stove operates, and vice-versa.

The variable resistor 66 may be manually controlled or any electronic equivalent that can be made to respond to outside sensors. For example, the variable resistor 66 may be a potentiometer set up as a variable resistor with one operating terminal 79 grounded, the terminal 80 being the wiper, and the terminal 84 serving as the V2 terminal. Alternatively, the variable resistor 66 may be an outside sensor such as a negative temperature coefficient (NTC) thermistor having one terminal 80 coupled to the wiper 82 of the potentiometer 60, and the other terminal 84 serving as the V2 terminal. When the thermistor is warmed-up by the surrounding space to be heated by a stove, the resistance of the thermistor will lower, the voltage V2 to the speed control comparator 172 will increase and the stove to be controlled will slow down as was previously explained. A fall in the thermistor temperature will have the opposite effect and the stove will speed-up to provide more heat. In other words, the speed control mode of the controller 10 automatically adjusts or modulates the power to stove motors in response to remote sensors such as outside air sensors, time clocks or other sensors so that the heat output better follows the demand for heat.

The stove controller 10 includes a "start on high" or power-up mode that causes full ac power to be applied to the stoker motors coupled to the controller 10 for a period of time, for example 20 seconds, for reliable restarting of the stove after a power interruption. The resistor 142 and the capacitor 148 form an R-C timing circuit. When power is applied to a stove, the capacitor 148 begins to charge with current through the resistor 142. The voltage at the junction 146 between the capacitor 148 and the resistor 142 begins to rise from zero volts as the capacitor 148 charges. The rising voltage is fed to the inverting terminal 154 of the power-up comparator 150. The resistors 136, 138 form a voltage divider. The voltage from V+is divided in half by this network and fed to the non-inverting terminal 152 of the power-up comparator 150. After power is applied and until the voltage on the capacitor 148 builds up to the voltage at the non-inverting input 152 of the power-up comparator 150, the output 166 of the power-up comparator 150 is high. The pull up resistor 168 provides a voltage to the anode of the reverse blocking diode 170. When the output 166 of the power-up comparator 150 is in the high state, this voltage is fed to the base 96 of the transistor 98 through the base resistor 100 to turn-on the transistor 98 which causes the thyristor 12 to be activated at each zero crossing of the line voltage, thereby supplying maximum power to the stove or stoker motors causing the stoker to run on high. When the voltage on the capacitor 148 and the inverting input 154 of the power-up comparator 150 builds up to the voltage supplied to the non-inverting input 154 of the power-up comparator 150 (for example, about 20 seconds), the output 166 of the comparator 150 goes to a low state having a voltage level that will not keep the transistor 98 "on". Thus at the time the voltage level at the output 166 of the power-up comparator 150 goes low, the "start on high" or power-up mode is ended and the transistor 96 will be controlled by other inputs to its base 96 for controlling the activation of the thyristor 12. The resistors 162, 164 and the PNP transistor 156 form a drain network to remove the charge from the capacitor 148 when power to the stove is removed. The transistor 156 is maintained "off" as long as V+ is available. When V+ goes to zero the transistor 156 goes "on" and the charge on the capacitor 148 is drained to ground through the transistor 156. The discharge of the capacitor 148 allows the timing cycle for the "start on high" or power-up mode to operate properly after a short power interruption.

The voltage level V+ is available at the second thermostat terminal 88 through the current limiting resistor 90 for connection to a two wire thermostat. When the thermostat calls for heat, current passes through the thermostat and into the second terminal at the terminal 88 and through the current limiting resistor 94 through the reverse blocking diode 92 to the base 96 of the transistor 98 to be turned "on" which causes the thyristor 12 to be activated when its gate 18 is pulsed at each zero crossing of the line voltage thus supplying maximum power to the stoker causing the stoker to run at full speed. When the thermostat is satisfied (open) control of the transistor 98 is returned to the output of the speed control comparator 172 or power-up comparator 150 for activating the thyristor 12. For each mode of operation, the resistor 102 is a pull-down resistor to prevent spurious turn-on of the transistor 98.

The controller 10 also sends full power to stove motors coupled to the controller 10 when power is being supplied to the stove by an inverter. The reason full power is passed by the controller 10 to stove motors coupled to the controller is because inverters often generate poorly-shaped waveforms that are not easily susceptible to regulation by a control circuit. A low voltage signal (for example, about 3 to 5 volts DC) derived from an inverter sensing signal or as a result of the inverters being "on" can be fed to a terminal marked "inverter" at the anode 108 of the diode 104. The DC voltage supplied by an inverter causes current to flow through the diode 104 and through the base resistor 100 to the base 96 of the transistor 98, which causes the transistor 98 to turn-on and the thyristor 12 to be activated at each zero crossing of the inverter voltage wave. In this way, maximum power is supplied to the stove while power is being supplied by the inverter.

Although this invention has been shown and described with respect to an exemplary embodiment thereof, it should be understood by those skilled in the art that the foregoing and various other changes, omissions, and additions in the form and detail thereof may be made therein without departing from the spirit and scope of the invention.

What is claimed is:

1. A speed controller for a solid fuel stove, comprising:

a bidirectional switch to be interposed along an ac power line, the switch having a first operating terminal to be coupled to an ac power source generating ac waveforms, a second operating terminal to be coupled to a solid fuel stove power terminal, and a control terminal for activating the switch to pass the ac waveforms to the stove via the switch when the control terminal is energized;

a full wave rectifier to be coupled to the ac power source for generating full wave rectified waveforms;

reference means coupled to the output of the full wave rectifier for generating a DC reference voltage having an averaged magnitude derived from the full wave rectified waveforms;

means for comparing a voltage magnitude of the full wave rectified waveforms to that of the DC reference voltage, and sending an activation signal to the control terminal of the bidirectional switch for turning-on the switch to pass a portion of the ac waveform to the stove for a length of time during each cycle of the full wave rectified waveform when the voltage magnitude of the full wave rectified waveform is generally greater than or equal to that of the DC reference voltage, whereby the stove operates in a reduced or speed control mode; and means to be coupled to a thermostat for sending an activation signal from the thermostat to the control terminal of the bidirectional switch for turning-on the switch to substantially pass full ac waveforms to the stove, whereby the stove operates in a full power mode.

2. A speed controller as defined in claim 1, further including start-up means to be coupled to the ac power source for sending an activation signal to the control terminal of the bidirectional switch for turning-on the switch generally when the controller first receives power from the ac power source to substantially pass full ac waveforms to the stove for a predetermined length of time.

3. A controller as defined in claim 1, further including inverter sense means to be coupled to an inverter for sending an activation signal to the control terminal of the bidirectional switch for turning-on the switch to substantially pass full ac waveforms to the stove when receiving power from the inverter.

4. A speed controller as defined in claim 1, further including thermostat sense means to be coupled to the thermostat for sending an activation signal to the control terminal of the bidirectional switch for turning-on the switch to substantially pass full ac waveforms to the stove when receiving an activation signal from the thermostat.

5. A speed controller as defined in claim 1, wherein the bidirectional switch is a triac.

6. A speed controller for a solid fuel stove, comprising:

a bidirectional switch to be interposed along an ac power line, the switch having a first operating terminal to be coupled to an ac power source generating ac waveforms, a second operating terminal to be coupled to a solid fuel stove power terminal, and a control terminal for activating the switch to pass the ac waveforms to the stove via the switch when the control terminal is energized;

a full wave rectifier to be coupled to a reduced voltage ac power source for generating full wave rectified waveforms;

a voltage divider circuit having an input coupled to an output of the full wave rectifier, and an output for providing reduced-voltage full wave rectified waveforms defining a sampled voltage;

a voltage averaging circuit having an input coupled to the output of the full wave rectifier, and an output for providing an averaged magnitude voltage of the full wave rectified waveforms generated from the full wave rectifier;

a speed control comparator having a first input coupled to the output of the voltage divider circuit, a second input coupled to the output of the voltage averaging circuit, and an output coupled to the control terminal of the bidirectional switch, whereby the speed control comparator goes to one of a digitally high and low state to activate the bidirectional switch to pass a portion of the ac waveforms to the stove for a length of time during each cycle of the full wave rectified waveform when the sampled voltage is generally greater than or equal to the averaged magnitude voltage, such that the stove operates in a reduced or speed control mode; and a thermostat interface for sending an activation signal from the thermostat to the control terminal of the bidirectional switch for turning-on the switch to substantially pass full ac waveforms to the stove, whereby the stove operates in a full power mode.

7. A speed controller as defined in claim 6, wherein the first input of the speed control comparator is a non-inverting input, the second input of the speed control comparator is an inverting input, and the speed comparator goes to a digitally high state to activate the bidirectional switch.

8. A speed controller as defined in claim 6, wherein the bidirectional switch is a triac.

9. A speed controller as defined in claim 6, further including an optical coupler interposed between the output of the speed control comparator and the control input of the bidirectional switch for providing electrical isolation to protect the speed control comparator and other low voltage component from high voltage power being passed through the bidirectional switch.

10. A speed controller as defined in claim 6, wherein the voltage averaging circuit includes a negative temperature coefficient (NTC) thermistor having an output terminal providing the averaged magnitude voltage, the averaged magnitude voltage being relatively low at cold temperatures and being relatively high at warm temperatures.

11. A speed controller as defined in claim 6, wherein the voltage averaging circuit includes a variable resistor having an output terminal providing the averaged magnitude voltage.

12. A speed controller as defined in claim 6, wherein the voltage averaging circuit includes a potentiometer configured as a variable resistor having an output terminal providing the averaged magnitude voltage.

13. A speed controller as defined in claim 6, further including:

a DC voltage regulator having an input coupled to the output of the full wave rectifier and having an output for providing a regulated DC supply voltage;

a timing circuit including a resistor connected in series with a capacitor, the resistor having a free end coupled to a DC reference voltage, and the capacitor having a free end coupled to a relatively low potential, the timing resistor and capacitor being coupled at a junction for providing a timing circuit voltage;

a second voltage divider circuit having a high voltage end coupled to the output of the DC voltage regulator, and having an output for providing a reduced DC supply voltage; and a start-up comparator having a first input coupled to the output of the voltage divider circuit, a second input coupled to the output of the timing circuit, and an output coupled to the control terminal of the bidirectional switch, the output of the start-up comparator being one of a digitally high and low state to activate the bidirectional switch to substantially pass full ac waveforms to the stove for a predetermined length of time after the timing circuit initially receives electrical energy from the ac power source.

14. A speed controller as defined in claim 13, wherein the first input of the start-up comparator is a non-inverting input, the second input of the start-up comparator is an inverting input, and the start-up comparator goes to a digitally high state to activate the bidirectional switch.

15. A method of controlling the speed of a solid fuel stove, comprising the steps of:

rectifying an ac power source signal to provide full wave rectified waveforms;

averaging the magnitude of a reference voltage derived from the full wave rectified waveforms to provide a DC reference voltage;

comparing a voltage magnitude of the full wave rectified waveforms to that of the DC reference voltage; and passing a portion of the ac waveforms to an output terminal to power a solid fuel stove for a length of time during each cycle of the full wave rectified waveform when the voltage magnitude of the full wave rectified waveform is generally greater than or equal to that of the DC reference voltage, whereby a stove operates in a reduced or speed control mode; and passing full ac waveforms to an output terminal to power the solid fuel stove upon receiving an activation signal from a thermostat.

16. A method of controlling as defined in claim 15, wherein the step of passing includes activating the gate of a triac to turn the triac on in order to pass ac power through the triac.

17. A method of controlling as defined in claim 15, further including the step of passing full electrical power to a solid fuel stove for a predetermined length of time upon receiving a signal to indicate start-up of the stove.

18. A method of controlling as defined in claim 15, further including the step of passing full ac waveforms to a solid fuel stove upon receiving an activation signal from an inverter power source.

* * * * *

UNITED STATES PATENT AND TRADEMARK OFFICE

CERTIFICATE OF CORRECTION

PATENT NO. : 5,920,168

DATED : July 6, 1999

INVENTOR(S) : DENNIS E. LEWIS

It is certified that error appears in the above-identified patent and that said Letters Patent is hereby corrected as shown below:

On the title page:

Item [76] Inventor: Please change the Inventor's middle initial from "R." to --E.--

Signed and Sealed this

Eighteenth Day of April, 2000

*Attest:*

*Attesting Officer*

Q. TODD DICKINSON

*Director of Patents and Trademarks*